US008440041B2

(12) United States Patent
Hamanaka et al.

(10) Patent No.: US 8,440,041 B2
(45) Date of Patent: May 14, 2013

(54) LENS PAD, LENS PAD MANUFACTURING METHOD, LENS MANUFACTURING METHOD, AND ADHESIVE MEMBER

(75) Inventors: Akira Hamanaka, Tokyo (JP); Daiji Sagami, Nara (JP)

(73) Assignees: Hoya Corporation, Tokyo (JP); Vigteqnos Co., Ltd., Nara (JP)

( * ) Notice: Subject to any disclaimer, the term of this patent is extended or adjusted under 35 U.S.C. 154(b) by 214 days.

(21) Appl. No.: 12/650,265

(22) Filed: Dec. 30, 2009

(65) Prior Publication Data

US 2010/0170627 A1 Jul. 8, 2010

(30) Foreign Application Priority Data

Jan. 6, 2009 (JP) ..... 2009-000642

(51) Int. Cl.
*B29C 65/00* (2006.01)
*B32B 37/00* (2006.01)
*B32B 38/10* (2006.01)

(52) U.S. Cl.
USPC ..... 156/249; 156/247; 156/154; 156/256; 156/248

(58) Field of Classification Search ..... 156/256, 156/248, 154, 153, 270, 247, 249; 427/207.1
See application file for complete search history.

(56) References Cited

U.S. PATENT DOCUMENTS

2004/0126575 A1* 7/2004 Yoshida et al. ..... 428/343
2005/0064125 A1* 3/2005 Tsukida et al. ..... 428/40.1

FOREIGN PATENT DOCUMENTS

| | | | |
|---|---|---|---|
| CN | 101043975 | A | 9/2007 |
| JP | 02001343617 | * | 12/2001 |
| JP | 2004-249454 | A | 9/2004 |
| JP | 2004-330327 | A | 11/2004 |
| JP | 2005-111612 | A | 4/2005 |
| JP | 2006-39239 | * | 2/2006 |
| JP | 2006-095657 | A | 4/2006 |
| JP | 2007-268706 | A | 10/2007 |
| WO | WO 2006/041024 | A1 | 4/2006 |
| WO | WO 2008/149890 | A1 | 12/2008 |

* cited by examiner

*Primary Examiner* — Linda L Gray
(74) *Attorney, Agent, or Firm* — Blakely, Sokoloff, Taylor & Zafman

(57) ABSTRACT

A lens pad includes a blank, first adhesive layer, and release sheet. The first adhesive layer is formed on one surface of the blank. The release sheet comes into tight contact with the surface of the first adhesive layer to protect this surface. The arithmetic average roughness of the surface of the release sheet on the side of the first adhesive layer is 0.1 μm or less. The surface of the first adhesive layer from which the release sheet is peeled off is attached onto a lens as an edging target. A lens pad, a lens pad manufacturing method, a lens manufacturing method, and an adhesive member are also disclosed.

3 Claims, 4 Drawing Sheets

LENS PAD, LENS PAD MANUFACTURING METHOD, LENS MANUFACTURING METHOD, AND ADHESIVE MEMBER

BACKGROUND OF THE INVENTION

The present invention relates to a lens pad, a lens pad manufacturing method, a lens manufacturing method, and an adhesive member.

Techniques for water-repellent finishing on the surfaces of various substances are known. When the surface of a substance undergoes a water-repellent treatment, its surface energy decreases and this inhibits adhesion of other substances onto the surface. Hence, a water-repellent surface exhibits not only a water-repellent effect but also an excellent antifouling performance. Also, because a water-repellent surface cannot strongly stick and hold the adhering substances, even dirt adhering on the surface can be removed easily. Moreover, because a water-repellent surface has a relatively low coefficient of friction, it feels smooth when one directly or indirectly touches it with his or her finger.

However, since a water-repellent surface inhibits adhesion of other substances, it naturally inhibits adhesion of adhesive tape as well. In other words, even when adhesive tape is attached onto a water-repellent surface, it readily peels off. In addition, when a force acts on the adhesive surface of the adhesive tape in the direction of shearing, the adhesion of the adhesive tape on the water-repellent surface is readily released, and the attachment portion of the adhesive tape is consequently prone to shift.

One example of the water-repellent finishing target is spectacle lenses. Some kinds of spectacle lenses have undergone water-repellent finishing so as to prevent, e.g., sebum contamination attributed to a touch with the fingers and dust particle contamination. A lens manufacturing process in which such a lens is framed in a spectacle frame includes a step of attaching adhesive tape onto a water-repellent surface. Furthermore, in this step, a heavy load is imposed on the adhesive interface. Details of this step will be described below.

A spectacle lens is manufactured by grinding or cutting the peripheral surface of a round lens (to be also referred to as a target lens or simply referred to as a lens hereinafter) by a rotary edging tool such as a grindstone or a cutter based on the edge shape data of a spectacle frame to shape the lens into an edge shape conforming to the shape of the spectacle frame. Edging of a spectacle lens needs not only to conform to the shape of a frame but also to produce optical characteristics involved at positions that follow the owner's prescriptions concerning, e.g., his/her focal position and cylinder axis. In other words, specific regions on a target lens must be shaped into specific shapes.

Japanese Patent Laid-Open No. 2007-268706 (patent reference 1) describes shaping (edging) of a target lens by a grindstone or a cutter while clamping the convex and concave surfaces of the target lens at the edging center portion using an edging jig attached on a lens rotating shaft. The edging jig includes a lens holder onto which the convex surface of the lens is fixed, and a lens retainer which presses the concave surface of the lens. A lens pad including adhesive layers on its both surfaces is inserted between the lens holder and the lens, and the lens is fixed onto the lens holder by the adhesive force of the pad. When the lens is stably fixed, it can be shaped into a specific edge shape.

However, it is difficult to stably attach the above-mentioned pad onto a water-repellent lens. Furthermore, when a water-repellent lens is shaped into a specific edge shape using a rotary edging tool, a shearing force is inflicted on the interface between the adhesive surface of the pad and the lens surface. Under such demanding conditions, the attachment position of the pad is prone to shift. When this occurs, the adhesive force of the pad may fail to follow a load on it attributed to rotation of the edging tool, resulting in a phenomenon (axial deviation phenomenon) in which the attachment position of the pad shifts in the rotation direction.

To combat this situation, an adhesive pad which can stably attach onto even a water-repellent lens and withstand an edging load on it is under study.

Japanese Patent Laid-Open No. 2005-111612 (patent reference 2), for example, describes a technique for forming a grinding axial deviation preventive pad from a five-layered body including a first adhesive layer, cushion layer, bond layer, resin film, and second adhesive layer. The cushion layer has a thickness of 0.2 to 3 mm, an elongation of 150 to 500%, and a tensile strength of 5 to 200 kg/cm$^2$. The bond layer has a bonding strength of 2,100 kg/25 mm. The resin film has an elongation of 50 to 700% and a tensile strength of 25 to 300 MPa. Such a technique described in patent reference 2 adjusts the thickness of the cushion layer to suppress damage inflicted on the lens when it is pressed by a lens fixing jig, and lowers the tensile strength of the cushion layer to suppress a phenomenon in which the adhesive surface floats (peels off) due to a load imposed on it by a rotary tool.

Japanese Patent Laid-Open No. 2004-330327 (patent reference 3) describes a technique for forming a lens fixing member from a composite adhesive sheet including a flexible double-sided adhesive cushion sheet and flexible single-sided adhesive sheet, brings the adhesion target surface of the single-sided adhesive sheet into press contact with one adhesive surface of the double-sided adhesive cushion sheet, and setting the bonding surface of the single-sided adhesive sheet to have a bonding area larger than that of the bonding surface of the double-sided adhesive cushion sheet. The technique described in patent reference 3 damps and absorbs, by the double-sided adhesive cushion sheet, impacts attributed to, e.g., pressing of the lens by the lens fixing jig and ensures a large attachment area of the flexible single-sided adhesive sheet, thereby attaching the cushion sheet onto a water-repellent lens surface. In other words, the technique described in patent reference 3 allows cutting of a water-repellent lens by stacking sheets of different roles on each other.

Japanese Patent Laid-Open No. 2004-249454 (patent reference 4) describes a technique associated with adhesive tape having an adhesive surface to come into contact with a lens. This technique adjusts the adhesive force of the adhesive surface of the tape such that its measurement value is 4 gf (0.0392 N) or more when an adhesion test according to the 180-degree peeling method stipulated in ISO29682 "Adhesive Tape/Adhesive Sheet Test Method" is conducted using a polyethylene terephthalate plate, with its surface treated by a fluorosilicone release agent, as a test plate. The technique described in patent reference 4 also specifies the adhesion strength of adhesive tape when it is peeled off at 180°. However, it is difficult to obtain an expected effect even by specifying the adhesive strength by its adhesive force acting upon its peel-off because the sheet itself is pressed by the lens fixing jig at the time of lens shaping.

Japanese Patent Laid-Open No. 2006-95657 (patent reference 5) is characterized by forming a minute opening in the adhesive surface of adhesive tape. Patent reference 5 also describes a mechanism in which the adhesive surface sticks onto the lens surface through the opening upon bonding them.

However, even the use of the tape described in patent reference 5 may result in an axial deviation when the adhesive surface floats due to entrance of water or air into the opening during edging.

Each of the lens pads described in patent references 2 to 4 described above is formed from a layered body including a soft adhesive layer and cushion layer. For this reason, a grinding load and a rotation moment remarkably concentrate on the adhesive surface. In this case, when a lens 3 fixed on a lens holder 1 through a pad 2 is attached onto a lens rotating shaft (not shown) and clamped by both the lens holder 1 and a lens retainer 4, as indicated by a solid line in FIG. 6, compressive deformation at the central portion of a cushion layer 5 of the pad 2 is large due to an edging load and a clamping pressure (chucking pressure) but that in the outer peripheral portion of the cushion layer 5 is small. Therefore, as the outer peripheral portion of a lens-side adhesive layer 6 separates and floats from a convex surface 3*a* of the lens 3, the adhesion area reduces and the original adhesion capacity of the adhesive surface degrades because the grinding fluid enters from the gap. This makes it difficult to perfectly prevent any axial deviation phenomenon of the lens 3. Note that an alternate long and two short dashed line 7 indicates the state of the pad 2 before its deformation.

The technique described in patent reference 5 leads to a reduction in area of the region where the adhesive layer sticks onto the lens surface through the minute opening. The peripheral portion of the opening serves as the boundary between the adhesive region and the non-adhesive region. The length of the boundary increases in proportion to the area of the adhesive region. The boundary between the adhesive region and the non-adhesive region becomes the point of origin where the tape floats from the lens surface. If the pad is attached onto a surface with a surface energy high enough to maintain a good adhesion state, the length of the boundary is less problematic. In contrast, if the pad is applied to a water-repellent lens surface with a low surface energy, the rate of occurrence of floating rises with increasing length of the boundary. This makes it impossible to maintain a good adhesion state in the adhesive region. When the pad is attached onto a water-repellent lens surface, the use of tape with a specification including a minute opening makes it impossible to maintain a tight contact state between the tape and the lens surface, resulting in an axial deviation phenomenon.

SUMMARY OF THE INVENTION

The present invention has been made to solve the above-mentioned problems, and has as its object to provide a lens pad which allows satisfactory shaping of even a water-repellent lens with a relatively low coefficient of surface friction free from any axial deviation, a method of manufacturing the same, and a lens manufacturing method.

It is another object of the present invention to provide an adhesive member which can maintain a good attachment state between the adhesive surface and an adhesion target surface with a relatively low coefficient of surface friction even when a shearing force is inflicted on their interface.

In order to achieve the above object, according to the present invention, there is provided a lens pad comprising a blank, a first adhesive layer formed on one surface of the blank, and a release sheet which comes into tight contact with a surface of the first adhesive layer to protect the surface, wherein an arithmetic average roughness of a surface of the release sheet on a side of the first adhesive layer is not more than 0.1 μm, and the surface of the first adhesive layer from which the release sheet is peeled off is attached onto a lens as an edging target.

DESCRIPTION OF THE PREFERRED EMBODIMENT

In order to solve the above-mentioned problems, the inventors of the present invention paid attention to the influence of the surface roughness of the lens-side adhesive layer 6 on the occurrence of an axial deviation. As the surface of the adhesive layer 6 becomes smoother, a non-adhesive region attributed to roughness is less likely to form. The inventors speculated that the occurrence of floating of adhesive tape is suppressed by exploiting the foregoing fact because the boundary between the adhesive region and the non-adhesive region reduces as a result. To confirm the adhesive force of the adhesive tape, lens pads with different surface roughnesses were fabricated, and an experiment was conducted using them. The experimental result revealed that an axial deviation can be prevented by setting the surface roughness of the adhesive surface to be equal to or less than a certain threshold to prevent the lens-side adhesive layer 6 from floating from the lens 3. An embodiment of the present invention devised in consideration of the above-mentioned situation will be described in detail below with reference to the accompanying drawings.

Figure 1:
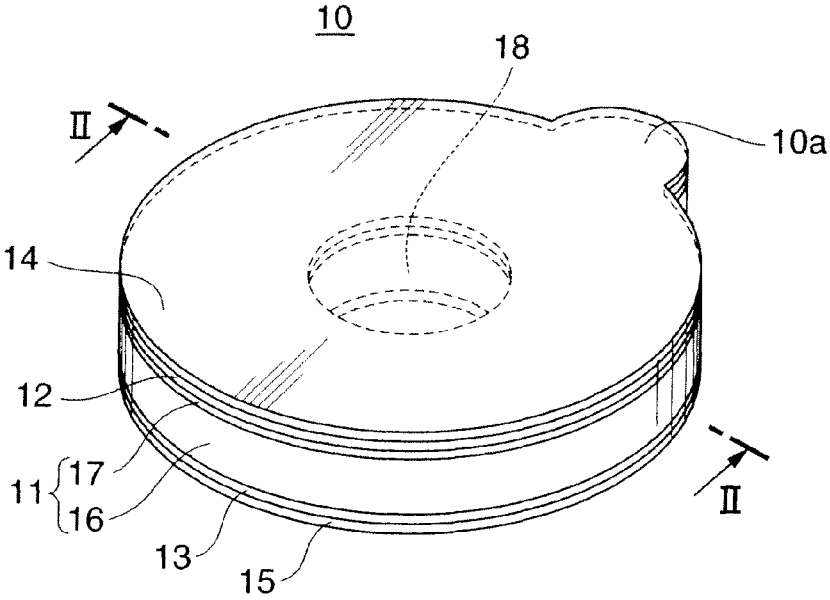
FIG. 1 is a perspective view showing the outer appearance of a lens pad according to one embodiment of the present invention.
Figure 2:
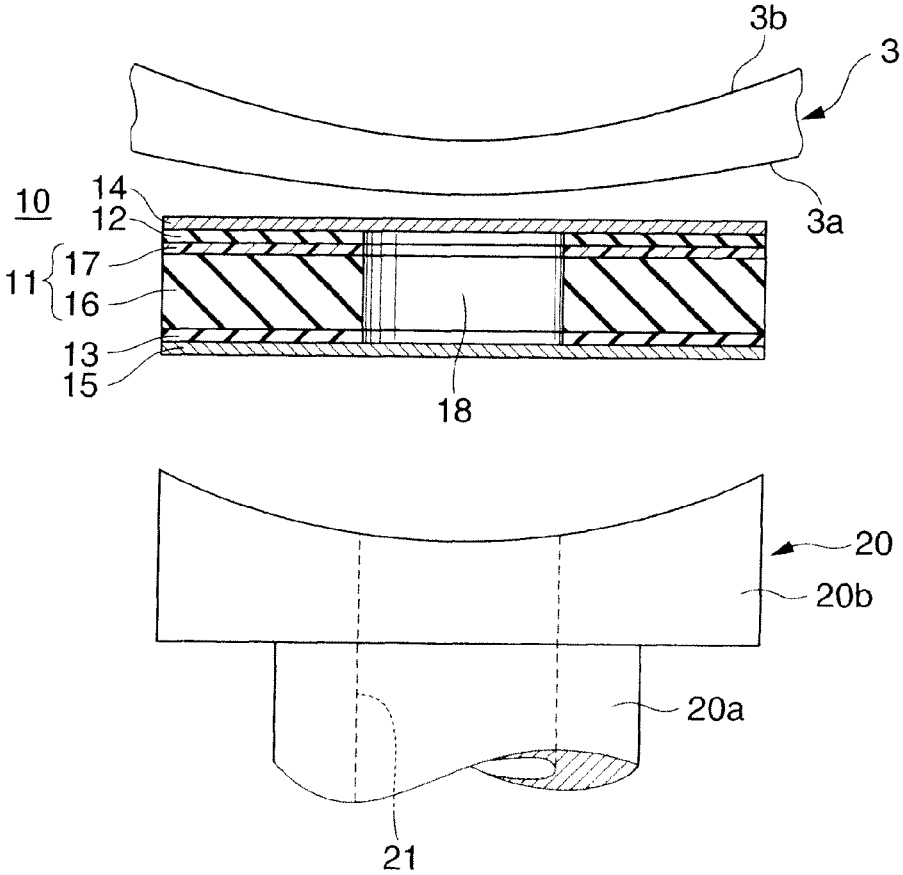
FIG. 2 is an enlarged sectional view taken along the direction of a line II-II in FIG. 1.

As shown in FIGS. 1 and 2, a lens pad 10 includes a blank 11 and a lens-side adhesive layer (first adhesive layer) 12 and jig-side adhesive layer (second adhesive layer) 13 which are respectively attached on both sides of the blank 11. Release sheets 14 and 15 are attached on the surfaces of the lens-side adhesive layer 12 and jig-side adhesive layer 13, respectively, before the use of the lens pad 10. The blank 11 includes a cushion layer 16 and core layer 17. The core layer 17 is inserted between the lens-side adhesive layer 12 and the cushion layer 16.

The lens pad 10 is formed in a toroid to have a central hole 18 and integrally includes a projection 10*a* which projects from a part of its outer periphery. The projection 10*a* is gripped by the fingers while the lens pad 10 is peeled off from a lens 3 or a lens holder 20, thus facilitating the peel-off of the lens pad 10.

The material of the lens-side adhesive layer 12 is appropriately selected in accordance with the edging state of the lens surface. A detailed example of that state is the coefficient of static friction of the lens surface. Preferably, an adhesive which forms the adhesive layer 12 does not peel off from the lens 3 during grinding of the lens 3 and can be easily removed after the grinding. More specifically, the adhesive layer 12 is preferably formed from an acrylic or rubber adhesive.

The thickness of the adhesive layer 12 is preferably 15 to 50 μm. When the lens surface has a coefficient of static friction of 0.003 to 0.1 and has undergone a surface treatment such as water-repellent finishing, the adhesive force of the adhesive layer 12, which acts on the water-repellent surface, is preferably 0.05 to 0.16 N/25 mm, depending on the thickness of the cushion layer 16 used in combination. The shearing force of the adhesive layer 12, which acts on the water-repellent surface, is preferably 60 to 80 N (Attachment Area: 25 mm×25 mm). The tensile strength of the adhesive layer 12 (its surface) is preferably 3 to 10 kg/cm$^2$ and, especially preferably, 4 to 8 kg/cm$^2$ at an elongation of 10%, depending on the composition of the cushion layer 16 used in combination. When the adhesive layer 12 is adjusted within the above-mentioned ranges, any axial deviation phenomenon can be suppressed even for a water-repellent lens.

Assume that a convex surface 3*a* of the lens 3 is coated with a water-repellent finish of a fluorine-containing silane compound. This is unpreferable because the adhesive force reduces when the air enters between the lens 3 and the adhesive layer 12. Hence, the surface (adhesive surface) of the adhesive layer 12 on the side of the lens 3 is preferably smooth. More specifically, the arithmetic average roughness of the adhesive surface of the adhesive layer 12 on the side of the lens 3 is preferably 0.1 μm or less and is more preferably 0.06 μm or less.

The surface shape of the release sheet 14 is transferred onto the adhesive surface of the adhesive layer 12. Hence, to attain a surface roughness that falls within the above-mentioned preferable range, it is only necessary to adjust the roughness of the surface, of the release sheet 14, which comes into tight contact with the adhesive layer 12. More specifically, the arithmetic average roughness of the surface of the release sheet 14 is preferably 0.1 μm or less and is more preferably 0.06 μm or less.

The release sheet 14 need only be flexible, be hard to crease attributed to bending, and have a roughness that falls within the above-mentioned range on its surface which comes into tight contact with the adhesive layer 12, and the material of the release sheet 14 is not particularly limited. A preferable material of the release sheet 14 is, e.g., paper, plastic, metal or glass having a smooth surface which comes into tight contact with the adhesive layer 12. A plastic sheet is especially preferable because it is easy to handle. Moreover, a plastic sheet which has its surface smoothed easily and is hard to bend is excellent in protection of the adhesive layer 12. The material of the plastic sheet is preferably a polyolefin resin such as polyethylene (PE), polypropylene (PP), or polyethylene terephthalate (PET). In addition, polystyrene resin, acrylic resin, or cellulosic resin, for example, can be used.

As long as a smooth plastic sheet or the like is used as the release sheet 14, the adhesive layer 12 strongly sticks onto even the water-repellent lens 3. In this case, the lens 3 can be shaped free from any axial deviation. The adhesive surface of the adhesive layer 12 is preferably covered with the release sheet 14 until it is used.

Figure 4:
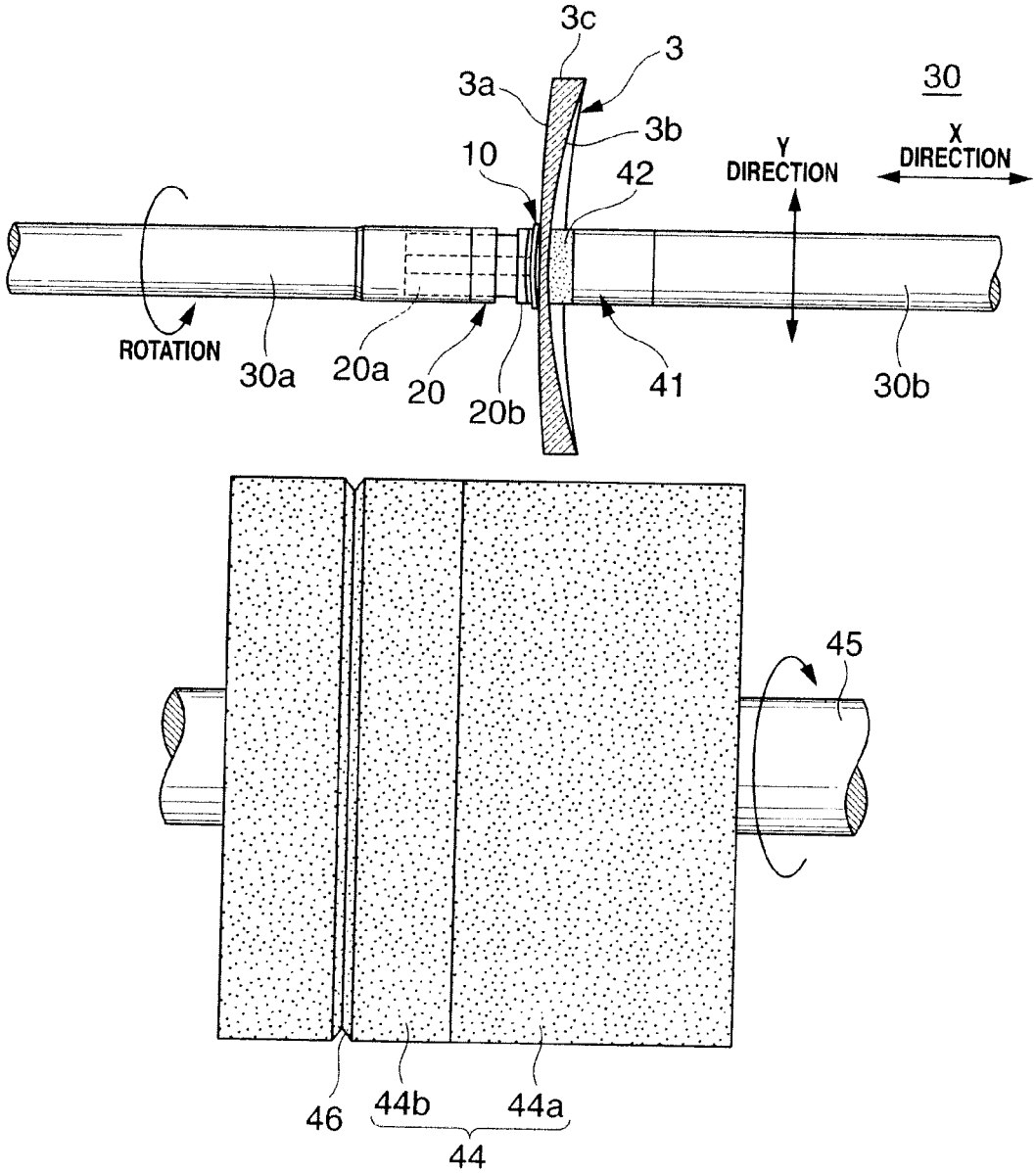
FIG. 4 is a view for explaining lens edging by an edging apparatus.

The material of the jig-side adhesive layer 13 need only be appropriately selected in accordance with the distal end shape and material of a lens retainer 41 (FIG. 4). A urethane, acrylic, silicone, or rubber adhesive can be typically adopted, depending on the material of the end face of the lens retainer 41.

The thickness of the jig-side adhesive layer 13 is preferably 15 to 50 μm and is especially preferably 20 to 35 μm. The adhesion strength of the adhesive surface of the jig-side adhesive layer 13 is preferably equal to an adhesive force of 5 to 30 N/25 mm for SUS. The adhesion strength means the value measured in the same way as in the adhesive layer 12.

The surface of the jig-side adhesive layer 13 is preferably covered with the release sheet 15 until it is used as well. The material of the release sheet 15 is not particularly limited, and can be either known release paper or release film. Also, because the jig-side adhesive layer 13 is not attached onto the lens 3, its surface roughness is not particularly limited, and the jig-side adhesive layer 13 need only have a sufficient adhesive force.

A material having an elongation of 100 to 500% and an elasticity of 5 to 200 kg/cm$^2$ is preferably selected for the cushion layer 16. Assume that the cushion layer 16 has a tensile strength less than 5 kg/cm$^2$. This is unpreferable because the cushion layer 16 deformed upon edging is hard to restore its original shape, resulting in an axial deviation. Assume that the cushion layer 16 has a tensile strength more than 200 kg/cm$^2$. This is again unpreferable because the cushion layer 16 is hard to expand, resulting in floating of the lens pad 10 from the lens surface. A more preferable tensile strength is 5 to 180 kg/cm$^2$. Although the substance of the cushion layer 16 is not particularly limited, it is typically, for example, polyurethane or silicone resin, various types of rubber, various types of elastomers, or foam materials thereof.

The elongation and tensile strength of the cushion layer 16 represent herein the values measured in conformity with JIS K6767 (method A). Assume that the elongation is lower than 100%. This is unpreferable because strong impacts acting in the first stage of grinding (cutting) cannot be perfectly absorbed, resulting in floating or peel-off of the lens pad 10 from the lens surface. Assume that the elongation is higher than 500%. This is unpreferable because the cushion layer 16 may twist due to even a relatively light edging load in the late stage of edging, resulting in an axial deviation. A more preferable elongation is 110 to 400%.

The thickness of the cushion layer 16 is preferably 0.5 to 1.5 mm. Assume that the cushion layer 16 has a thickness less than 0.5 mm. In this case, the cushion layer 16 cannot perfectly absorb a chucking pressure attributed to the jig and therefore the load localizes on the lens surface. Load localization is unpreferable because it gives a local impact to the blank 11 or the surface treatment layer of the lens 3. Assume that the cushion layer 16 has a thickness of 1.5 mm or more. This is unpreferable because the cushion layer 16 often twists due to even the grinding (cutting) pressure in the late stage of cutting, resulting in an axial deviation.

The core layer 17 is not particularly limited as long as it is made of a material which uniformly transfers the pressing load of the lens retainer 41 to the cushion layer 16 and is hard to deform due to a torque transferred during cutting. Hence, the core layer 17 is preferably made of a material harder than that of the cushion layer 16. Although the thickness of the core layer 17 is not particularly limited, it is typically 20 to 100 μm. The core layer 17 is made of, for example, polyester resin, polyolefin resin, silicone resin, or polyurethane resin.

The core layer 17 having the above-mentioned structure can prevent, e.g., damage inflicted on the pad 10 by keeping the rigidity of the pad 10 itself high. The lens-side adhesive layer 6 and core layer 17 are preferably tightly bonded to each other by, e.g., integration that exploits an adhesive or fusion. Both surfaces of the core layer 17 preferably have undergone a surface treatment such as a corona treatment or an anchoring agent treatment so as to enhance the bonding performance between the adhesive layer 12 and the cushion layer 16.

A bond which bonds the cushion layer 16 and the core layer 17 preferably has a bonding strength of 2 to 100 kg/25 mm. The bonding strength represents herein the value measured in conformity with JIS Z1522. If the bonding strength is weaker than 2 kg/25 mm, this is unpreferable because the bond suffers a cohesive failure. If the bonding strength is stronger than 100 kg/25 mm, this is unpreferable because the bond suffers cracking. A more preferable bonding strength is 2 to 80 kg/25 mm. Although the thickness of the bond is not particularly limited, it is typically 1 to 200 μm. No bond is necessary when the core layer 17 and the cushion layer 16 are integrated with each other by, e.g., fusion.

The lens 3 is a plastic minus-power lens with a round shape (e.g., Diameter: 80 mm), which is formed by, for example, cast polymerization. The lens 3 has the convex-side lens surface (convex surface) 3*a*, a concave-side lens surface (concave surface) 3*b*, and an outer peripheral surface (peripheral surface) 3*c* (FIG. 3). A protective coating layer and a water-repellent coating layer are stacked on each of the convex surface 3*a* and convex surface 3*b*.

The protective coating layer is formed so as to improve the optical characteristics, durability, and abrasion resistance of the lens 3, and typically includes a hard coating layer and antireflection coating layer. The water-repellent coating layer is formed so as to improve the antifouling performance and prevent any water stain by enhancing the smoothnesses of the optical surfaces 3*a* and 3*b*. In recent years, an extreme water-repellent lens with high smoothness is prevailing. A water-repellent material containing, for example, an organosilicon compound containing a fluorine-substituted alkyl group is employed as the water-repellent member. Note that the peripheral surface 3*c* is edged into an edge shape matching the spectacle frame shape by an edging apparatus (to be described later).

Figure 3A:
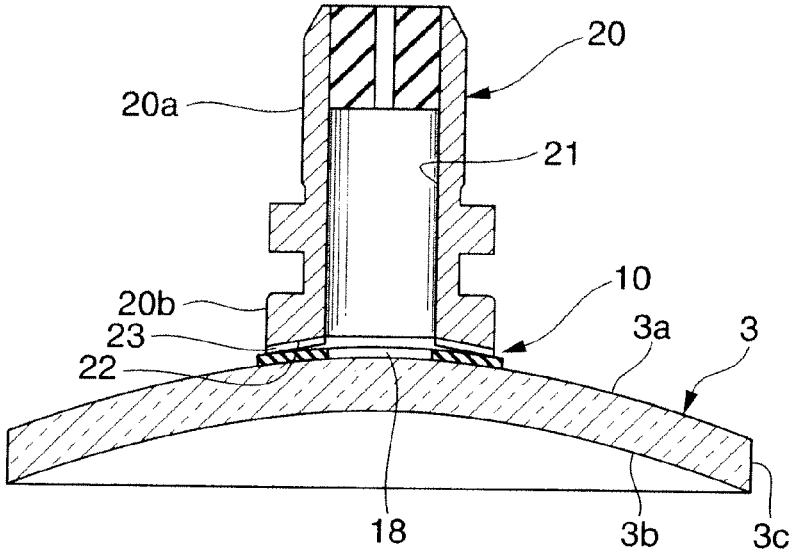
FIG. 3A is a sectional view showing the state in which a lens is fixed on a lens holder through a lens pad.
Figure 3B:
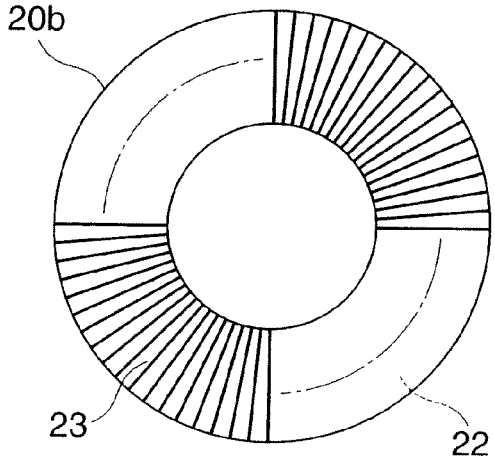
FIG. 3B is a plan view showing the lens holding surface of the lens holder.
Figure 3C:
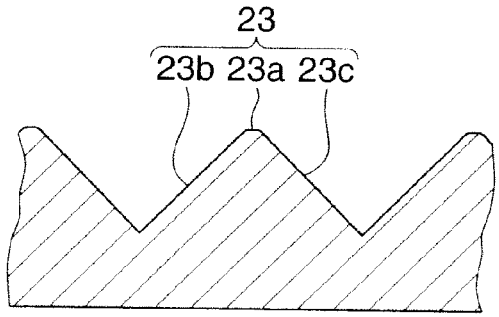
FIG. 3C is an enlarged sectional view of the main part of the lens holding surface of the lens holder.

The lens holder 20 will be explained with reference to FIGS. 3A to 3C. The lens holder 20 is formed into a cylinder by a metal such as stainless steel so as to include a fitting shaft portion 20*a* and a lens holding portion 20*b* integrally formed at the distal end of the fitting shaft portion 20*a*. The fitting shaft portion 20*a* has, for example, a length of 35 mm, an outer diameter of about 14 mm, and a central hole 21 with a diameter of about 10 mm.

The lens holding portion 20*b* has a lens holding surface 22 which holds the convex surface 3*a* of the lens 3. The lens holding surface 22 is formed in a concave spherical shape roughly corresponding to the convex surface 3*a* of the lens 3. The central portion of the convex surface 3*a* of the lens 3 is fixed onto the lens holder 20 through the lens pad 10. The edging center of the lens 3 is the spectacle frame center or the optical center of the lens 3. However, the prism measurement reference point of a progressive-power lens or the geometrical center that is nearly the same as the optical center of a single-vision lens, for example, is also preferable as that edging center.

The radius of curvature of the lens holding surface 22 is set smaller than that of the convex surface 3*a* so as to bring only the outer peripheral portion of the lens holding surface 22 into contact with the convex surface 3*a* to stably hold the lens 3. The outer diameter of the lens holding portion 20*b* is nearly equal to that of the lens pad 10. The diameter of the central hole 21 is nearly equal to that of the central hole 18 in the lens pad 10.

Furthermore, a multiple of minute protrusions 23 are radially formed on the lens holding surface 22 throughout its entire periphery so as to enhance the tight bonding force with the lens pad 10. The protrusion 23 has an isosceles triangular cross-section so as to form a wall surface 23*b* on the side of the rotation direction of the lens holder 20 and a wall surface 23*c* on its opposite side as surfaces inclined at the same angle (e.g., 45°) with respect to a top 23*a* of the protrusion 23. When the wall surfaces 23*b* and 23*c* have the same inclination angle, the lens pad 10 uniformly comes into tight contact with both the inclined surfaces. In this case, it is possible to exploit the flexibility and deformability of the lens pad 10 to appropriate degrees because of an increase in contact area, thus increasing the lens holding force. In addition, in this case, because the lens pad 10 uniformly comes into press contact with both the surfaces 23*b* and 23*c* inclined at the same angle, any unbalanced torques cancel out each other and this prevents deterioration in holding accuracy of the lens 3 attributed to a rotational shift of the lens pad 10.

Lens edging by an edging apparatus will be explained with reference to FIG. 4. A lens rotating shaft 30 which mounts the lens 3 includes coaxial horizontal first and second lens rotating shafts 30*a* and 30*b*. The first lens rotating shaft 30*a* is rotatably disposed and mounts the lens 3 through the lens holder 20 at its distal end. The lens holder 20 is detachably attached onto the first lens rotating shaft 30*a* by fitting the fitting shaft portion 20*a* into a fitting hole formed in the distal end surface of the first lens rotating shaft 30*a*. The second lens rotating shaft 30*b* is disposed to be rotatable and movable in the axial direction (X direction). The lens retainer 41 is detachably attached onto the distal end surface, facing the first lens rotating shaft 30*a*, of the second lens rotating shaft 30*b* as well. An elastic body 42 such as rubber which presses the central portion of the concave surface of the lens 3 is fixed at the distal end of the lens retainer 41.

The lens rotating shaft 30 including the first and second lens rotating shafts 30*a* and 30*b* as mentioned above is controlled to be driven in three directions, i.e., the rotation direction about the shaft line, the horizontal direction (X direction) parallel to the shaft line, and the vertical direction (Y direction) perpendicular to the shaft line based on the shaping data of the lens 3 during edging of the lens 3, thereby grinding the peripheral surface 3*c* of the lens 3 by a grinding tool 44.

The grinding tool 44 is, for example, a grindstone such as a cylindrical diamond wheel. The grinding tool 44 includes a grindstone 44*a* for use in primary grinding (coarse grinding) and a grindstone 44*b* for use in secondary grinding (finish grinding). A beveling groove 46 that is a bilateral V-shaped annular groove is formed in the outer peripheral surface of the grindstone 44*b* for use in secondary grinding.

The lens 3 is shaped by primary grinding of the peripheral surface 3*c* of the lens 3 by the grinding tool 44 based on the shaping data of the lens 3 while rotating the lens rotating shaft 30 and grinding tool rotating shaft 45. The primary grinding step is a step of forming the lens 3 into a primary shape by coarse grinding of the peripheral surface 3*c* by the grindstone 44*a* for use in primary grinding.

After the primary grinding is completed, the peripheral surface 3*c* is continuously ground by the grindstone 44*b* for use in secondary grinding (secondary grinding) to shape the peripheral surface 3*c* into an edge shape matching the spectacle frame shape, and the shaping is completed.

In this manner, the lens 3 is fixed onto the lens holding surface 22 of the lens holder 20 through the lens pad 10. This makes it possible to prevent any axial deviation of the lens 3 during shaping of the lens 3 and, in turn, to shape the lens 3 into a predetermined edge shape. That is, when the central portion of the concave surface of the lens 3 is pressed by the lens retainer 41 to push the convex surface 3*a* against the lens holding surface 22 of the lens holder 20 through the lens pad 10, the core layer 17 of the lens pad 10 deforms. Because the core layer 17 is a hard layer, it uniformly receives the pressing force of the lens retainer 41 throughout its entire surface and, in turn, uniformly transfers the received force to the cushion layer 16. Hence, the outer peripheral portion of the lens-side adhesive layer 12 of the lens pad 10 never floats and separates from the convex surface 3*a* of the lens 3 due to a chucking pressure or a grinding pressure acting on the lens 3. This makes it possible to maintain a large adhesive force and, in turn, to prevent any axial deviation of the lens 3 during grinding.

The cushion layer 16 of the lens pad 10 twists and deforms in a direction opposite to the rotation direction of the lens rotating shaft 30 due to a grinding load imposed on it during edging to absorb a shearing force inflicted on the interface between the lens 3 and the lens-side adhesive layer 12. This makes it possible to prevent shearing of the lens pad 10. Also, when the thickness of the cushion layer 16 is set to 0.5 mm to 1.5 mm, it is possible to damp a large impact in the initial stage of grinding. This, in turn, makes it possible to satisfactorily shape even a lens with high water repellency free from any axial deviation. The lens pad 10 includes the core layer 17 to protect the convex surface 3*b* of the lens 3 from the lens retainer 41.

Example 1

In this Example, pads respectively including release sheets A, B, C, D, E, F, and G with different surface roughnesses were used to compare and examine the differences in axial deviation performance attributed to the roughnesses of the lens-side adhesive surfaces of the respective release sheets.

The features of the respective release sheets and the roughnesses of their surfaces which come into tight contact with a lens-side adhesive layer will be explained first.

The release sheet A is a transparent sheet made of polyethylene terephthalate, has an arithmetic average roughness of 0.06 μm, and exhibits a roughness curve with a maximum cross-sectional height of 0.66 μm.

The release sheet B is a transparent sheet made of polyethylene terephthalate, has an arithmetic average roughness of 0.02 μm, and exhibits a roughness curve with a maximum cross-sectional height of 0.184 μm.

The release sheet C is a paper sheet and its surface which comes into tight contact with the lens-side adhesive layer is smoothed. The smoothed surface of the release sheet C has an arithmetic average roughness of 0.033 μm and exhibits a roughness curve with a maximum cross-sectional height of 0.332 μm.

The release sheet D is a white sheet made of polyethylene terephthalate and its surface which comes into tight contact with the lens-side adhesive layer has an arithmetic average roughness of 0.084 μm and exhibits a roughness curve with a maximum cross-sectional height of 0.899 μm.

The release sheet E is a white sheet made of polyethylene terephthalate as well and its surface which comes into tight contact with the lens-side adhesive layer has an arithmetic average roughness of 0.103 μm and exhibits a roughness curve with a maximum cross-sectional height of 1.18 μm.

Pads respectively including the release sheets F and G are comparative examples.

The release sheet F is a white sheet made of polyethylene terephthalate and its surface which comes into tight contact with the lens-side adhesive layer has an arithmetic average roughness of 0.12 μm and exhibits a roughness curve with a maximum cross-sectional height of 2.34 μm.

The release sheet G is a paper sheet and its surface which comes into tight contact with the lens-side adhesive layer is smoothed. The smoothed surface of the release sheet G has an arithmetic average roughness of 0.15 μm and exhibits a roughness curve with a maximum cross-sectional height of 1.6 μm.

In this experiment, the influence of the surface roughness of a lens-side release sheet 14 was examined using an adhesive pad including a 1.2-mm cushion layer 16 and a lens-side adhesive layer 12 with an adhesive force of 0.04 N/25 mm, a shearing force of 78 N/mm (N/Attachment Area: 25 mm×25 mm), and a tensile strength of 4N/mm$^2$ at an elongation of 10%. Table 1 shows the experimental result.

TABLE 1

| No. | Release Sheet | Ra (μm) | Rmax (μm) | Evaluation of Axial Deviation | Material of Release Sheet |
|---|---|---|---|---|---|
| 1 | A | 0.06 | 0.66 | Excellent | Transparent PET |
| 2 | A | 0.06 | 0.66 | Excellent | Transparent PET |
| 3 | A | 0.06 | 0.66 | Excellent | Transparent PET |
| 4 | A | 0.06 | 0.66 | Excellent | Transparent PET |
| 5 | B | 0.021 | 0.184 | Excellent | Transparent PET |
| 6 | B | 0.021 | 0.184 | Excellent | Transparent PET |
| 7 | C | 0.033 | 0.332 | Excellent | Release Sheet Super-smoothing Process |
| 8 | C | 0.033 | 0.332 | Excellent | Release Sheet Super-smoothing Process |
| 9 | D | 0.084 | 0.899 | Excellent | White PET |
| 10 | D | 0.084 | 0.899 | Good | White PET |
| 11 | E | 0.103 | 1.18 | Good | White PET |
| 12 | E | 0.103 | 1.18 | Good | White PET |
| 13 | F | 0.12 | 2.34 | Poor | White PET |
| 14 | F | 0.12 | 2.34 | Poor | White PET |
| 15 | G | 0.15 | 1.6 | Poor | Release Sheet Smoothing Process |
| 16 | G | 0.15 | 1.6 | Poor | Release Sheet Smoothing Process |

Excellent: The axial deviation is less than 0.3°
Good: The axial deviation is 0.3° (inclusive) to 0.5° (exclusive)
Poor: The axial deviation is 0.5° or more The edging apparatus is set under edging conditions: a load of 3.5 kg is imposed on a lens 3; a lens rotating shaft 30 is rotated at a speed of 5 rpm; and a grinding tool rotating shaft 45 is rotated at a speed of 3,600 rpm.

A lens pad 10 is of a toroid type having an outer diameter of 22 mm and a central hole 18 with a diameter of 6 mm, and integrally includes a projection 10*a* in its outer periphery.

The target lens 3 is a lens (Trade Name: EYAS) manufactured by HOYA and has undergone water-repellent coating (Coefficient of Kinetic Friction: 0.07 to 0.1). The uncut lens diameter is 75 mm and the edged lens shape is a binocular half-eye shape (Horizontal Dimension: 54 mm; Vertical Dimension: 26 mm; and Decentering: 5 mm).

The result shown in Table 1 reveals that the release sheets A to E are desirable as the release sheet 14 and the axial deviation can be kept below 2° when the arithmetic average roughness of the surface, of the release sheet 14, which comes into tight contact with the lens-side adhesive layer 12 is about 0.1 μm or less and the maximum cross-sectional height of the roughness curve is about 1.0 μm or less. That result also reveals that an axial deviation phenomenon is preferably suppressed when the arithmetic average roughness of that surface is 0.06 μm and the maximum cross-sectional height of the roughness curve is 0.7 μm or less.

Figure 5A:
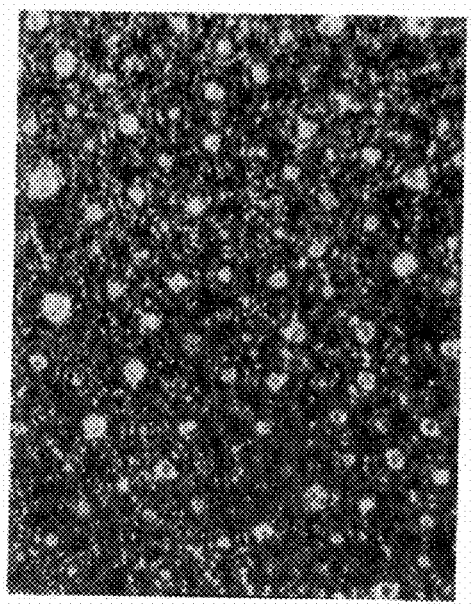
FIGS. 5A and 5B are photographs showing the adhesive surfaces of lens-side adhesive layers respectively including release sheets.
Figure 5B:
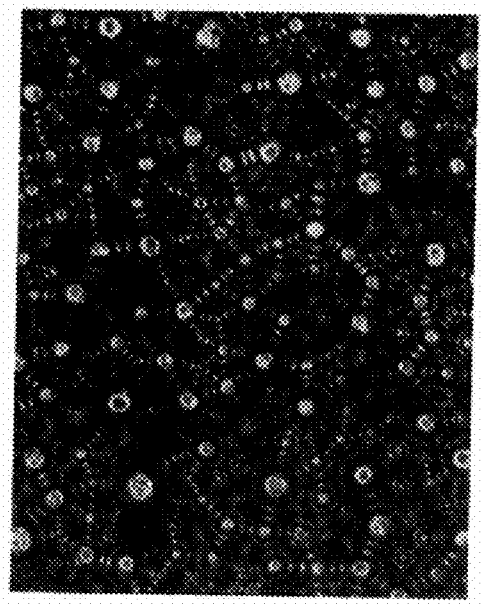
Figure 6:
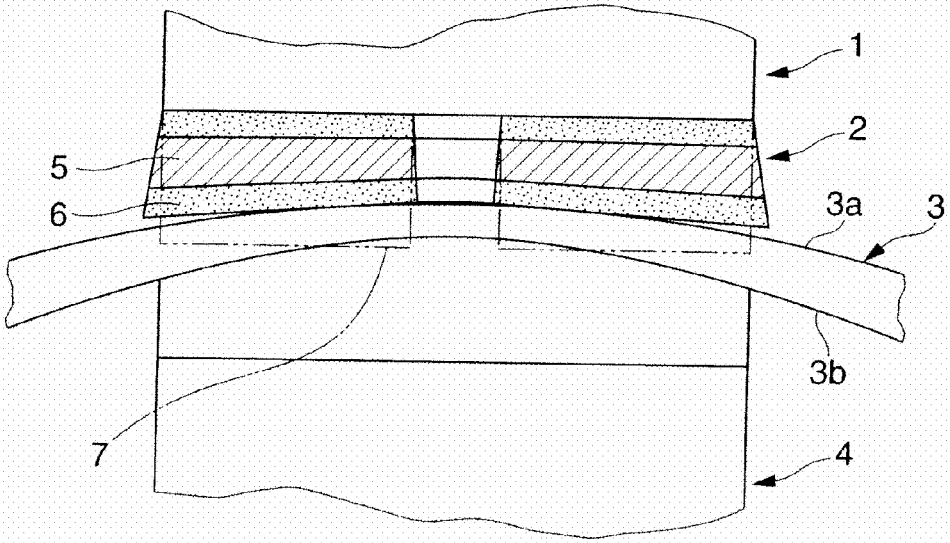
FIG.6 PRIOR ART
FIG. 6 is a view showing compressive deformation of a conventional pad attributed to a load on it when a lens is fixed on a lens holder through the pad.

FIG. 5A is a photograph showing the adhesive surface of the lens-side adhesive layer 12 including the release sheet E. FIG. 5B is a photograph showing the adhesive surface of the lens-side adhesive layer 12 including the release sheet A.

As can be seen from the photographs shown in FIGS. 5A and 5B, the adhesive surface of the lens-side adhesive layer 12 including the release sheet E which is made of a resin and has a relatively rough surface is bleached as compared with that of the lens-side adhesive layer 12 including the release sheet A with a smooth surface. The inventors of the present invention speculated that the bleaching is accounted for by diffused reflection of light due to nonuniformity of the adhesive surface. This experimental result reveals that it is hard for the lens pad 10 to come into tight contact with the lens surface when the adhesive surface is rough and therefore an axial deviation phenomenon is prone to occur during edging.

Example 2

Next, some samples of lens pads 10 which include cushion layers 16 with different thicknesses, blanks with different densities, and adhesive layers 12 and 13 with different adhesive forces and tensile strengths, and in which the lens-side adhesive layers 12 each include the release sheet A in Example 1 were created and the evaluation of an axial deviation in each sample upon shaping was checked. Table 2 shows the check result.

TABLE 2

| No. | Thickness of Cushion Layer mm | Blank Density g/cm$^3$ | Adhesive force of Water-repellent Coat N/(25 mm)$^2$ | Shearing Force of Water-repellent Coat N/mm$^2$ | Tensile Strength (N/mm$^2$) 10% N/mm$^2$ | 20% N/mm$^2$ | 50% N/mm$^2$ | Axial Deviation Evaluation |
|---|---|---|---|---|---|---|---|---|
| 1 | 0.5 | 0.24 | 0.14 | 82 | 2.7 | 5.3 | 7.3 | Fair |
| 2 | 0.8 | 0.32 | 0.14 | 82 | 2.7 | 5.3 | 7.3 | Fair |
| 3 | 1.2 | 0.32 | 0.14 | 82 | 2.7 | 5.3 | 7.3 | Good |
| 4 | 0.5 | 0.48 | 0.04 | 78 | 4.0 | 6.7 | 8.7 | Fair |
| 5 | 0.8 | 0.32 | 0.04 | 78 | 4.0 | 6.7 | 8.7 | Good |
| 6 | 1.2 | 0.24 | 0.04 | 78 | 4.0 | 6.7 | 8.7 | Good |
| 7 | 0.5 | 0.32 | 0.07 | 61 | 5.3 | 8.0 | 10.7 | Good |
| 8 | 0.8 | 0.48 | 0.07 | 61 | 5.3 | 8.0 | 10.7 | Fair |
| 9 | 1.2 | 0.24 | 0.07 | 61 | 5.3 | 8.0 | 10.7 | Fair |

Good: The axial deviation is less than 0.3°
Fair: The axial deviation is 0.3° (inclusive) to 0.5° (exclusive)

The edging apparatus is set under edging conditions: a load of 3.5 kg is imposed on a lens 3; a lens rotating shaft 30 is rotated at a speed of 5 rpm; and a grinding tool rotating shaft 45 is rotated at a speed of 3,600 rpm.

The lens pad 10 is of a toroid type having an outer diameter of 22 mm and a central hole 18 with a diameter of 6 mm, and integrally includes a projection 10*a* in its outer periphery.

The target lens 3 is a lens (Trade Name: EYAS) manufactured by HOYA and has undergone water-repellent coating (Coefficient of Kinetic Friction: 0.07 to 0.1). The uncut lens diameter is 75 mm and the edged lens shape is a binocular half-eye shape (Horizontal Dimension: 54 mm; Vertical Dimension: 26 mm; and Decentering: 5 mm).

The above-mentioned measurement result reveals that an axial deviation reduces as the thickness of the cushion layer 16 increases to 0.8 mm or more and the density decreases in the release sheet A with the above-mentioned surface roughness. Also, a pad which has a low density and in which the thickness of the cushion layer 16 is 0.8 mm or less causes a phenomenon in which a part of the cushion layer 16 cracks and remains on a lens holding surface 22 of a lens holder 20. This experimental result reveals that the thickness of the cushion layer 16 is preferably 0.8 mm or more.

The lens pad 10 mentioned above includes a blank 11, an adhesive layer 12 formed on one surface of the blank 11, and a release sheet 14 which comes into tight contact with the surface of the adhesive layer 12 to protect that surface. The arithmetic average roughness of the surface of the release sheet 14 on the side of the adhesive layer 12 is 0.1 μm or less. The surface of the adhesive layer 12 from which the release sheet 14 is peeled off is attached onto a lens 3 as an edging target.

The surface shape of the release sheet 14 is transferred onto the surface of the adhesive layer 12. For this reason, the surface roughness of the release sheet 14 corresponds to the virtual surface roughness of the adhesive layer 12. Hence, when the arithmetic average roughness of the surface of the adhesive layer 12 is 0.1 μm or less as in the release sheet 14, it is possible to maintain a good adhesion state between the lens pad 10 and the surface of the lens 3 even when a water-repellent lens 3 with a low surface energy is edged, thus satisfactorily suppressing any axial deviation phenomenon during grinding of the periphery of the lens 3.

At least the surface of the release sheet 14 on the side of the adhesive layer 12 is preferably made of a synthetic resin. This is because a synthetic resin is more easily formed to have a smooth surface than other materials such as paper materials. In addition, the release sheet 14 is desirably flexible and hard to crease attributed to bending.

The adhesive force of the adhesive layer 12 is preferably 0.03 to 0.2 N/25 mm. This makes it possible to satisfactorily suppress any axial deviation phenomenon even when the present invention is applied to a water-repellent lens 3 that is especially hard to grind.

The lens pad 10 also includes an adhesive layer 13 formed on the other surface of the blank 11 on the side opposite to that of one surface on which the adhesive layer 12 is formed.

The blank 11 preferably includes an elastic cushion layer 16. Although a heavy load is imposed on the lens 3 in the initial stage of its edging because the lens diameter is large in this stage and so a strong force (shearing force) acts on the interface between the lens pad 10 and the surface of the lens 3, this shearing force can be absorbed by the cushion layer 16 by its twisting deformation. This makes it possible to reduce the shearing force directly inflicted on the adhesive region on the lens pad 10 on the lens 3, thus more reliably suppressing any phenomenon in which the surface of the adhesive layer 12 separates from the surface of the lens 3. The thickness of the cushion layer 16 is more preferably 0.5 to 1.5 mm.

The blank 11 preferably moreover includes a core layer 17 made of a material harder than that of the cushion layer 16. Since the core layer 17 is made of a hard material, a chucking pressure or a grinding load can be almost uniformly transferred onto the entire surface of the cushion layer 16. Hence, because the outer periphery of the lens pad 10 never separates and floats from the lens 3 and therefore the adhesive force never reduces, it is possible to effectively suppress any axial deviation phenomenon of the lens 3.

The core layer 17 is preferably located on the surface of the cushion layer 16 on the side of the adhesive layer 12.

Although the blank 11 preferably has a double-layered structure including the cushion layer 16 and core layer 17, it may include only one of these two layers.

A method of manufacturing a lens pad 10 will be described briefly. First, an adhesive layer 12 is formed by coating a blank 11 with an adhesive material. Next, a release sheet 14 is brought into tight contact with the surface of the adhesive layer 12. The release sheet 14 used has an arithmetic average roughness of 0.1 μm or less on its surface on the side of the adhesive layer 12. Since the surface shape of the release sheet 14 is transferred onto the surface of the adhesive layer 12, the arithmetic average roughness of the adhesive layer 12 also becomes 0.1 μm or less. This makes it possible to obtain a lens pad 10 having a smooth lens-side adhesive surface.

A method of manufacturing a lens 3 using a lens pad 10 will be described briefly. First, a lens pad 10 is prepared. Using the lens pad 10, the central portion of a convex surface 3*a* of an uncut lens 3 is fixed onto a lens holding surface 22 of a lens holder 20. More specifically, release sheets 14 and 15 are peeled off from the surfaces of adhesive layers 12 and 13 on the lens pad 10, the surface of the adhesive layer 12 is attached at the central portion of the convex surface 3*a* of the lens 3, and the surface of the adhesive layer 13 is attached onto the lens holding surface 22 of the lens holder 20. Note that the release sheet 14 is preferably peeled off immediately before the adhesive layer 12 is attached onto the lens 3. The lens holder 20 on which the lens 3 is fixed is attached onto a lens rotating shaft 30 of an edging apparatus. The periphery of the lens 3 is edged into a desired shape. This makes it possible to shape even a water-repellent lens free from any axial deviation phenomenon during the shaping. This method is especially suitable for a plastic lens.

The present invention is not limited to a lens pad, and is also applicable to adhesive members for other use applications. An adhesive member may have the same structure as that of the lens pad 10. That is, an adhesive member includes a blank 11, an adhesive layer 12 formed on the blank 11, and a release sheet (release member) 14 which comes into tight contact with the surface of the adhesive layer 12 to protect that surface. The arithmetic average roughness of the surface of the release sheet 14 on the side of the adhesive layer 12 is 0.1 μm or less. This adhesive member can strongly stick onto even a water-repellent surface.

The adhesive member may also include an adhesive layer 13 formed on the other surface of the blank 11 on the side opposite to that of one surface on which the adhesive layer 12 is formed.

The adhesive member is applicable to, e.g., an indication label attached onto a water-repellent surface, and edging tape. When the adhesive member is applied to an indication label, peel-off and shift of the label are suppressed. This makes it possible to stably maintain the indication function of even a water-repellent article.

The adhesive member is also applicable to a protective member for a water-repellent article. It is a common practice to protect a water-repellent article by covering its surface with a plastic bag. However, even a water-repellent surface may suffer damage due to a physical impact or a scratch with a sharp object. The adhesive member can be preferably brought into tight contact with even a water-repellent surface as well. Hence, the water-repellent surface itself can be protected by employing a relatively hard plastic blank as the blank 11 of the adhesive member.

What is claimed is:

1. A lens pad manufacturing method comprising the steps of:

forming an adhesive layer having an adhesive force of 0.03-0.2 N/25 mm on a blank by coating the blank with an adhesive material;

bringing a release sheet whose surface on a side of the adhesive layer has an arithmetic average roughness of not more than 0.1 μm and a maximum cross-sectional height of a roughness curve of not more than 1 μm into tight contact with a surface of the adhesive layer, and attaching the surface of the adhesive layer from which the release sheet is peeled off onto a water-repellent lens surface.

2. A lens manufacturing method comprising the steps of:

preparing a lens pad comprising a blank, an adhesive layer formed on the blank and having an adhesive force of 0.03-0.2 N/25 mm, and a release sheet which comes into tight contact with a surface of the adhesive layer to protect the surface, the release sheet whose surface on a side of the adhesive layer has an arithmetic average roughness of not more than 0.1 μm and a maximum cross-sectional height of a roughness curve of not more than 1 μm;

fixing a central portion of a convex surface of a water-repellent lens onto a lens holding surface of a lens holder using the lens pad of which the release sheet is peeled off from the adhesive layer;

attaching the lens holder, on which the lens is fixed, onto a lens rotating shaft of an edging apparatus; and edging the lens.

3. A method according to claim 2, wherein the fixing step comprises the step of fixing an uncut plastic lens as the lens.

* * * * *